US006414287B2

(12) United States Patent
Han et al.

(10) Patent No.: US 6,414,287 B2
(45) Date of Patent: Jul. 2, 2002

(54) PARTS ARRANGEMENT STRUCTURE FOR DC MICROWAVE OVEN

(75) Inventors: Yong-woon Han, Kunpo; Seong-deog Jang; Kwang-seok Kang, both of Suwon; Dae-sung Han, Kyungki-do; Jin-ho Kim, Suwon; Han-seong Yoo, Yongin; Han-sung Kang, Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/804,137

(22) Filed: Mar. 13, 2001

(30) Foreign Application Priority Data

Mar. 31, 2000 (KR) ..... 2000-17033

(51) Int. Cl.[7] ..... H05B 6/66

(52) U.S. Cl. ..... 219/715; 219/756; 219/757; 219/760

(58) Field of Search ..... 219/756, 702, 219/715, 716, 757, 760, 754, 762

(56) References Cited

U.S. PATENT DOCUMENTS 4,549,054 A * 10/1985 Aoyama ..... 219/756
4,762,973 A * 8/1988 Schultz ..... 219/756
5,235,150 A * 8/1993 Buske et al. ..... 219/757

* cited by examiner

*Primary Examiner*—Philip H. Leung
(74) *Attorney, Agent, or Firm*—Robert E. Bushnell, Esq.

(57) ABSTRACT

Disclosed is a parts arrangement structure for a DC microwave oven which is formed by a combination of an upper panel, a lower panel and a rear panel, a space inside the DC microwave oven being divided into a device chamber in which a magnetron and an air guide are placed and a cooking chamber in which a rotating motor for rotating rollers and a turntable is placed, the DC microwave oven having a control panel which closes a front end of the device chamber. The parts arrangement structure comprises a high voltage transformer and an inverter circuit board mounted to the lower panel inside the device chamber; and at least one high voltage capacitor mounted to the lower panel below the cooking chamber.

6 Claims, 3 Drawing Sheets

PARTS ARRANGEMENT STRUCTURE FOR DC MICROWAVE OVEN

CLAIM OF PRIORITY

This application makes reference to, incorporate the same herein, and claims all benefits accruing under 35 U.S.C.§119 from an application for Structure for Arrangement Parts of a DC Microwave Oven earlier filed in the Korean Industrial Property Office on Mar. 31, 2000 and there duly assigned Ser. No. 17033/2000 by that Office.

BACKGROUND OF THE INVENTION

1. Field of the Invention

The present invention relates to a DC microwave oven, and more particularly, to a parts arrangement structure for a DC microwave oven, which enables a variety of parts to be disposed in the DC microwave oven in a manner such that adequate space utilization is affected and an efficient cooling system is accomplished.

2. Description of the Related Art

Recently, a DC microwave oven is disclosed in the art, which receives a DC voltage from a DC power source such as a battery in transporting means such as a motor vehicle or a passenger ship or in an outdoor field, inverts the DC voltage into a high AC voltage and drives a magnetron thereby to apply heat to and cook a food.

Because such a DC microwave oven has a characteristic that a magnetron is driven by a high AC voltage, in order to invert a DC voltage from a DC power source into an AC voltage, an inverter device for a low frequency of 50–500 Hz is needed, and, in order to generate a high AC voltage of 2–2.2 KV, a diversity of electrical parts such as a high voltage transformer, a high voltage capacitor, a high voltage diode and the like must be provided to the DC microwave oven.

Consequently, in the DC microwave oven, it is necessary to efficiently arrange the diversity of electrical parts such as the magnetron, inverter device, high voltage transformer, high voltage capacitor, high voltage diode and the like in a limited space of a device chamber which is defined in the DC microwave oven.

Moreover, as the diversity of electrical parts are arranged in the limited space of the device chamber which is defined in the DC microwave oven, there is raised a demand for a novel parts arrangement structure which is capable of effectively discharging heat which is unavoidably generated in the diversity of electrical parts.

SUMMARY OF THE INVENTION

Accordingly, the present invention has been made in an effort to solve the problems occurring in the related art, and an object of the present invention is to provide a parts arrangement structure for a DC microwave oven, which enables a variety of parts to be properly disposed in a limited space inside the DC microwave oven in a manner such that an efficient cooling system is accomplished.

In order to achieve the above object, according to one aspect of the present invention, there is provided a parts arrangement structure for a DC microwave oven which is formed by a combination of an upper panel, a lower panel and a rear panel, a space inside the DC microwave oven being divided into a device chamber in which a magnetron and an air guide are placed and a cooking chamber in which a rotating motor for rotating rollers and a turntable is placed, the DC microwave oven having a control panel which closes a front end of the device chamber, the parts arrangement structure comprising: a high voltage transformer and an inverter circuit board mounted to the lower panel inside the device chamber; and at least one high voltage capacitor mounted to the lower panel below the cooking chamber.

According to another aspect of the present invention, a repair opening for enabling a fault diagnosis service is defined in the lower panel adjacent to a place where the high voltage capacitor is mounted to the lower panel, and the repair opening is openably closed by a base cover.

According to still another aspect of the present invention, a cooling fan for cooling the magnetron, the high voltage transformer and the inverter circuit board and a fan motor are mounted to an inclined portion of the rear panel inside the device chamber.

By the features of the present invention, a high voltage transformer and an inverter circuit board are fixedly mounted, in a side by side relationship, to a lower panel in a device chamber of a DC microwave oven. A fan motor which has a cooling fan, is inclinedly mounted to a rear panel in a manner such that the cooling fan can blow air toward the high voltage transformer and the inverter circuit board through the magnetron. A plurality of high voltage capacitors are mounted to the lower panel below a cooking chamber of the DC microwave oven. A repair opening for enabling a fault diagnosis service for the high voltage capacitors is defined in the lower panel adjacent to a place where the high voltage capacitors are mounted to the lower panel in a manner such that the repair opening is openably closed by a base cover.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
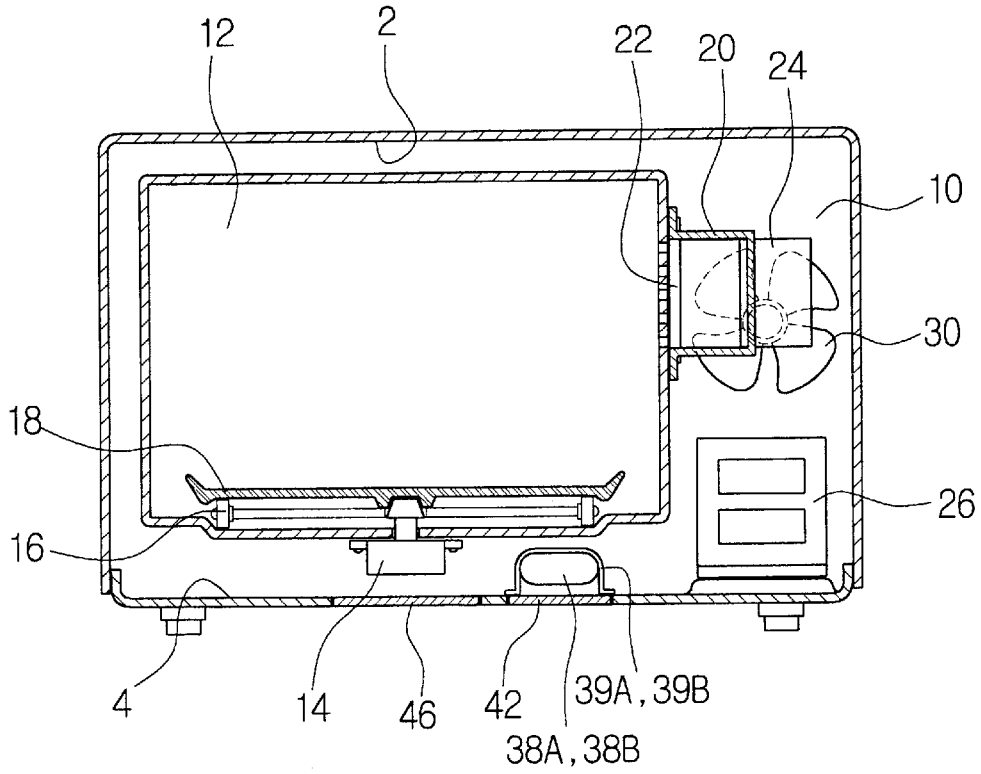
FIG. 1 is a front view illustrating a parts arrangement structure for a DC microwave oven in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or all like parts.

Figure 2:
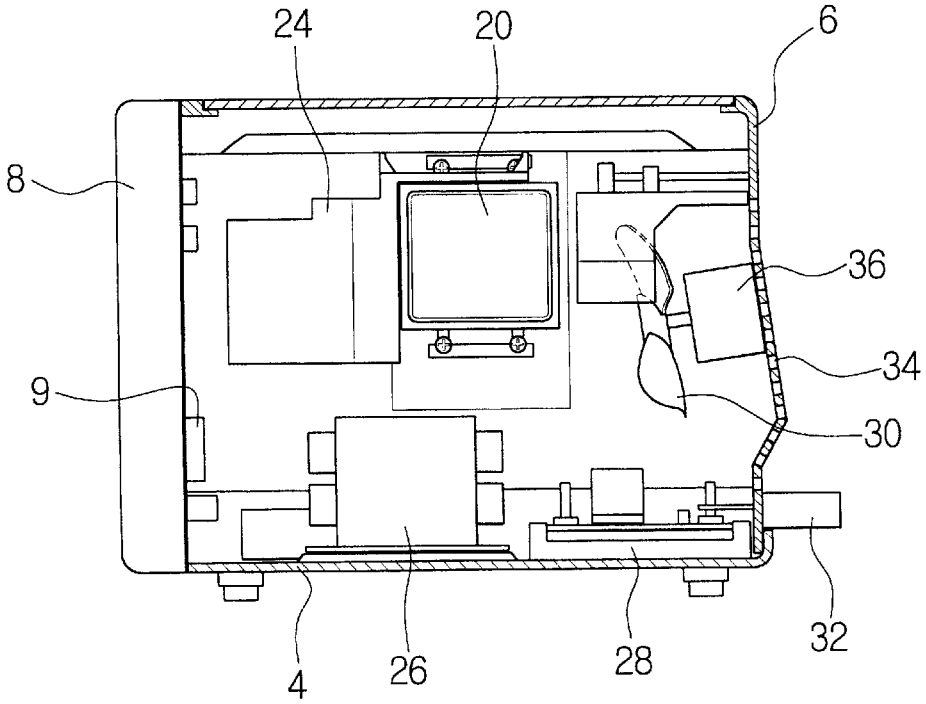
FIG. 2 is a partially cross-sectioned side view illustrating the parts arrangement structure in a device chamber defined in the DC microwave oven shown in FIG. 1 when the structure is viewed from a side.
Figure 3:
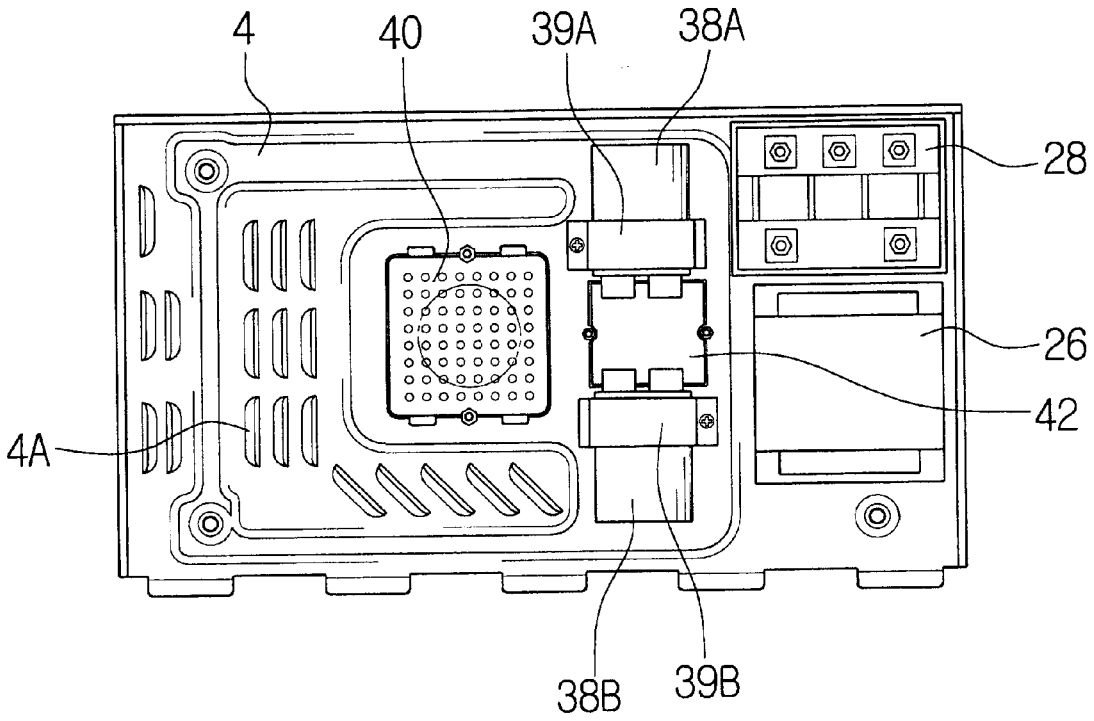
FIG. 3 is a plan view illustrating the parts arrangement structure on a lower panel of the DC microwave oven shown in FIG. 1 when the structure is viewed from a top.
Figure 4:
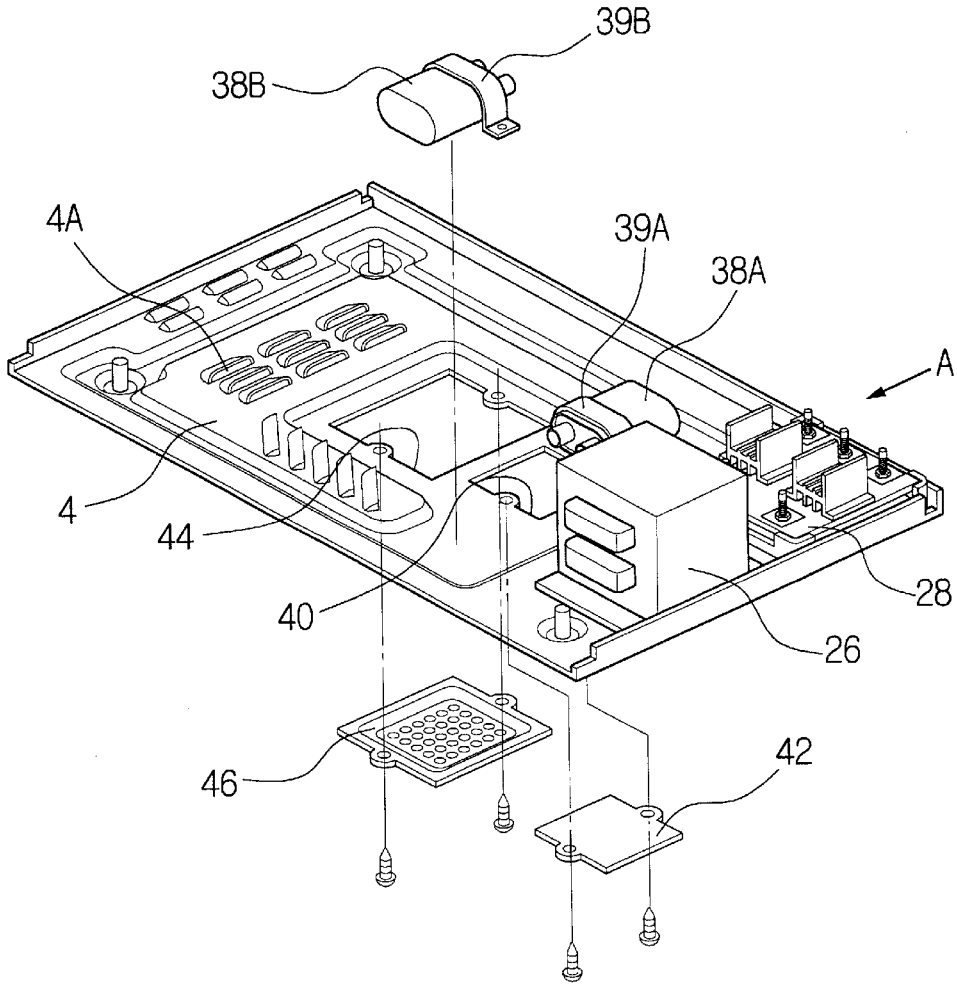
FIG. 4 is a partly exploded perspective view illustrating a sub-structure for enabling a fault diagnosis service for parts which are located on the lower panel shown in FIG. 3.
Figure 5:
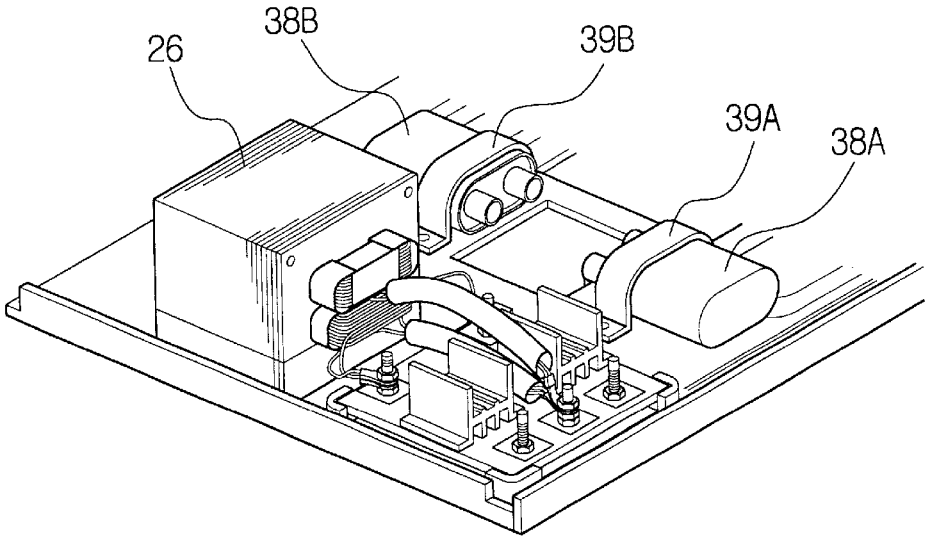
FIG. 5 is a perspective view showing FIG. 4 from a direction indicated by an arrow A.

As shown in FIGS. 1 through 5, according to a parts arrangement structure of the present invention, a DC microwave oven has a body which is formed by a combination of an upper panel 2, a lower panel 4 and a rear panel 6. A space inside the DC microwave oven is divided into a device chamber 10 and a cooking chamber 12.

A control panel 8 which has a plurality of buttons for enabling a user to implement various cooking functions, delimits a front end of the device chamber 10. In the device chamber 10, a main printed circuit board (PCB) 9 is mounted to a rear surface of the control panel 8. Control means such as a microcomputer for controlling the entire cooking functions of the DC microwave oven in response to button inputs on the control panel 8, etc. are placed on the main PCB 9. A variety of electrical parts of the DC microwave oven are electrically connected to the main PCB 9.

A front end of the cooking chamber 12 is delimited by a cooking chamber door which allows a food to be accommodated in the cooking chamber 12 and then the cooking chamber 12 to be closed. A rotating motor 14 is mounted to a lower surface of a bottom wall which delimits a bottom of the cooking chamber 12. The rotating motor 14 functions to rotate at a constant velocity rollers 16 and a turntable 18 which are placed on an upper surface of the bottom wall.

A magnetron 20 is mounted in the device chamber 10 to a side wall which delimits a side of the cooking chamber 12, in a manner such that the magnetron 20 is communicated with the cooking chamber 12 through a waveguide 22. An air guide 24 is mounted to the magnetron 20 so as to allow outside air to flow into the cooking chamber 12.

On the other hand, a high voltage transformer 26 and an inverter circuit board 28 are fixedly mounted to the lower panel 4 in a side by side relationship, with the lower panel 4 delimiting a lower end of the device chamber 10. The high voltage transformer serves to generate a high voltage of 2–2.2 KV which is to be applied to the magnetron 20. A multitude of inverter circuit elements are mounted to the inverter circuit board 28. The multitude of inverter circuit elements serve to invert a DC voltage which is inputted through an external power input section 32, into an AC voltage and supply the inverted AC voltage to the high voltage transformer 26.

Also, a cooling fan 30 is mounted via a fan motor 36 to the rear panel 6 in the device chamber 10, for blowing outside air toward the high voltage transformer 26 and the inverter circuit board 28. The cooling fan 30 is connected to a motor shaft of the fan motor 36 and is positioned at substantially an upper portion of the rear panel 6.

Here, the portion of the rear panel 6 to which the cooling fan 30 is mounted via the fan motor 36, is inclined so that the cooling fan 30 and the fan motor 36 face the high voltage transformer 26 and the inverter circuit board 28. A plurality of air inlet holes 34 for allowing outside air to flow into the device chamber 10 are defined throughout the inclined portion of the rear panel 6.

In the meanwhile, first and second high voltage capacitors 38A and 38B for boosting the DC voltage which is generated by the high voltage transformer 26, are fixedly clamped to the lower panel 4 below the cooking chamber 12 and in the device chamber 10, by means of first and second clamps 39A and 39B, respectively. The first and second high voltage capacitors 38A and 38B are oppositely arranged to each other.

Further, between the first and second high voltage capacitors 38A and 38B, the lowerpanel 4 is defined with a capacitor repair opening 40 which has a predetermined size. The capacitor repair opening 40 enables a fault diagnosis service for the first and second high voltage capacitors 38A and 38B to be implemented without disassembling the lower panel 4. The capacitor repair opening 40 is openably closed by a first base cover 42 using screws.

At this time, directly below the rotating motor 14, the lower panel 4 is defined with a motor repair opening 44. The motor repair opening 44 enables a fault diagnosis operation for the rotating motor 14 to be implemented without disassembling the lower panel 4. The motor repair opening 44 is openably closed by a second base cover 46 using screws.

In the meantime, a plurality of air outlet holes 4A are defined in the lower panel 4 below the cooking chamber 12.

In other words, as the cooling fan 30 is actuated by driving the fan motor 36, outside air flows into the device chamber 10 through the plurality of air inlet holes 34 which are defined in the rear panel 6. As described above, since the portion of the rear panel 6 in which the plurality of air inlet holes 34 are defined, is inclined, the outside air is blown toward the high voltage transformer 26 and the inverter circuit board 28. The outside air which passes through the high voltage transformer 26 and the inverter circuit board 28, cools the first and second high voltage capacitors 39A and 39B and the rotating motor 14, and then, is discharged to the outside through the plurality of air outlet holes 4A.

Here, it is to be readily understood that a portion of the outside air which passes through the high voltage transformer 26 and the inverter circuit board 28, can also cool the control panel 8 and the main PCB 9.

On the other hand, the outside air which is supplied toward the magnetron 20, flows through the air guide 24 into the cooking chamber 12 to ventilate the inside of the cooking chamber 12 and then discharged to the outside through a separate plurality of air outlet holes.

As a result, by the present invention, advantages are provided in that a variety of parts are properly disposed in a limited space inside a DC microwave oven, and thereby, an outside air circulating path is defined in an effective manner. Also, due to the fact that a repair opening for enabling a fault diagnosis service for an electrical part such as a high voltage capacitor is defined in a lower panel of the DC microwave oven, the fault diagnosis service for a corresponding part can be implemented in a convenient manner without disassembling outer panels as a whole.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A DC microwave oven comprising:

an upper panel;

a lower panel;

a rear panel;

a device chamber housing a magnetron and an air guide, said device chamber formed by said upper panel, said lower panel, and said rear panel;

a cooking chamber;

a rotating motor for rotating rollers and a turntable within said cooking chamber;

a control panel closing a front end of the device chamber;

a high voltage transformer and an inverter circuit board mounted on the lower panel; and a high voltage capacitor mounted on the lower panel below the cooking chamber.

2. The DC microwave oven of claim 1, said lower panel having an opening for enabling a fault diagnosis service, said opening formed in the lower panel adjacent to a place where the high voltage capacitor is mounted to the lower panel, and the opening being openably closed by a base cover.

3. The DC microwave oven of claim 1, further comprising:

a cooling fan for cooling the magnetron, the high voltage transformer and the inverter circuit board; and a fan motor, said rear panel having an inclined portion, said cooling fan and said fan motor mounted to said inclined portion of the rear panel.

4. A microwave oven comprising:

an upper panel;

a lower panel;

a rear panel;

a device chamber housing a magnetron and an air guide, said device chamber formed by said upper panel, said lower panel, and said rear panel;

a cooking chamber;

a rotating motor for rotating rollers and a turnable within said cooking chamber;

a high voltage transformer mounted on said lower panel; and a high voltage capacitor mounted on the lower panel below said cooking chamber.

5. The microwave oven of claim 4, said lower panel having an opening for enabling a fault diagnosis service, said opening formed in said lower panel adjacent to a place where said high voltage capacitor is mounted on said lower panel, and said opening being openably closed by a base cover.

6. The microwave oven of claim 4, further comprising:

a cooling fan for cooling said magnetron and said high voltage transformer; and a fan motor, said rear panel having an inclined portion, said cooling fan and said fan motor mounted to said inclined portion of said rear panel.

* * * * *